US008012391B2

(12) United States Patent
Heerens et al.

(10) Patent No.: US 8,012,391 B2
(45) Date of Patent: Sep. 6, 2011

(54) PROCESS FOR THE PRODUCTION OF REINFORCED AND CAST, CELLULAR OR FOAMED CONCRETE BODIES AND REINFORCEMENT SUPPORT FRAME FOR THE USE IN SUCH A PROCESS

(75) Inventors: Ingo Heerens, Waldkraiburg (DE); Peter Bayer, Aresing (DE)

(73) Assignee: Xella Baustoffe GmbH, Duisburg (DE)

( * ) Notice: Subject to any disclaimer, the term of this patent is extended or adjusted under 35 U.S.C. 154(b) by 91 days.

(21) Appl. No.: 12/443,650

(22) PCT Filed: Sep. 20, 2007

(86) PCT No.: PCT/EP2007/059980
§ 371 (c)(1),
(2), (4) Date: Jul. 8, 2009

(87) PCT Pub. No.: WO2008/040644
PCT Pub. Date: Apr. 10, 2008

(65) Prior Publication Data

US 2009/0301023 A1 Dec. 10, 2009

(30) Foreign Application Priority Data

Sep. 29, 2006 (DE) ..... 10 2006 046 311

(51) Int. Cl.
*B28B 23/02* (2006.01)

(52) U.S. Cl. ..... 264/215; 52/649.1; 249/128; 249/168

(58) Field of Classification Search ..... 52/649.1; 264/215; 249/128, 168
See application file for complete search history.

(56) References Cited

U.S. PATENT DOCUMENTS 2,979,801 A 4/1961 Gasmire

FOREIGN PATENT DOCUMENTS

| | | |
|---|---|---|
| DE | 1177 537 | 9/1964 |
| DE | 195 24 913 A1 | 1/1997 |
| EP | 0 060 232 A1 | 9/1982 |
| GB | 681 354 | 10/1952 |
| JP | 9-234725 | 1/1996 |
| JP | 2003-048006 | 2/2003 |
| JP | 2003-297608 | 10/2003 |
| JP | 2004-012809 | 1/2004 |

OTHER PUBLICATIONS

International Search Report Feb. 26, 2008—PCT/EP2007/056980.
International Search Report May 23, 2008—PCT/EP2007/059980.
Formelsammlung—XP002470484, Feb. 26, 2008.

*Primary Examiner* — Yogendra N Gupta
*Assistant Examiner* — Alison Hindenlang
(74) *Attorney, Agent, or Firm* — Brinks Hofer Gilson & Lione

(57) ABSTRACT

The invention relates to a process for the production of cellular or foamed, cast concrete bodies that are reinforced with metallic reinforcements, and to a reinforcement support frame for use in the production of cellular or foamed, cast concrete bodies that are reinforced with metallic reinforcing bars.

13 Claims, 6 Drawing Sheets

PROCESS FOR THE PRODUCTION OF REINFORCED AND CAST, CELLULAR OR FOAMED CONCRETE BODIES AND REINFORCEMENT SUPPORT FRAME FOR THE USE IN SUCH A PROCESS

CROSS REFERENCE TO RELATED APPLICATIONS

This application claims priority to German patent application number DE 10 2006 046 311.0, filed Sep. 29, 2006, and PCT/EP2007/059980, filed Sep. 20, 2007.

FIELD OF THE INVENTION

The invention relates to a process for the production of cellular or foamed concrete bodies, preferably structural components or slabs, respectively, comprising a metallic, especially steel reinforcement system, as well as to a reinforcement support frame for application in such a process.

BACKGROUND OF THE INVENTION

Foamed or cellular concrete bodies, respectively, have to be reinforced by well-known means for the purpose of withstanding not only high compressive loads but also tensile stresses. Commonly used reinforcements are bars, welded reinforcement mesh and/or e.g. steel reinforcement cages that are formed by welding reinforcement mesh. Referring to FIG. 10, for prior art, the production of such reinforced, foamed or cellular concrete bodies, respectively, usually fresh and workable concrete slurry of a well-known composition for cellular or foamed concrete is at first poured into e.g. a rectangular casting mould 100 and then previously welded reinforcement cages 101 are inserted into the fresh concrete slurry. It is important to position and fix the reinforcement cages 101 such that they are sufficiently spaced from the side-walls 102, base 103 of the casting mould 100 as well as the surface of the cast concrete component, so as to be completely enclosed by the concrete cover. The reinforcement cages 101 must be held in this preset position in the casting mould 100, until the cellular concrete slurry has sufficiently hardened and eventually expanded as a result of hydration, namely, attained its green strength and supports the reinforcement cages 101 by itself.

Providing a rectangular reinforcement support frame 104 that can be placed at the centre of the side walls 102 of the casting mould 100 for holding the reinforcement cages 101 during this initial hardening and optionally hydration process has been known. The reinforcement support frame 104 is provided with several beams 106 for reinforcement support or suspension. These beams can be moved along the longitudinal direction of the reinforcement support frame 104 and they span across the reinforcement support frame 104 and the casting mould 100 along the transverse horizontal direction. These reinforcement support beams 106 in turn exhibit several vertically-extending drill-holes and/or apertures 107 (illustrated only schematically). An essentially cylindrical supporting bar 108 is suspended through each of the drill-holes 107. Each of the reinforcement cages 101 is fastened to the supporting bar 108 such that after setting of the cast concrete, these rods 108 can be easily detached from the reinforcement cages 101 and drawn out of the hardened cast concrete. For instance, the reinforcement cages 101 are provided with one or more fasteners in the form of an oval hole or loop, with which each one the reinforcement cages is tied to a supporting bar 108. The supporting bars 108 exhibit, for instance, radially protruding prongs or hinge pins (not illustrated) for fastening the supporting bars 108 to the reinforcement cage 101. This is accomplished e.g. in the form of a bayonet closure or the like by turning the supporting bars 108 around their longitudinal axis after being tied to the loop-like fasteners. Thus, the reinforcement cages 101 are suspended at the supporting bars 108 at a plane positioned within the casting mould 100. In case of reinforcement cages 101 composed of superimposed reinforcement mesh 109, it is also common practice to interpose spacers and/or transverse connectors 110 made of e.g. plastic. They exhibit such an oval loop at the centre that facilitates their attachment to both reinforcement mesh 109.

Furthermore, it is known from EP 0 060 232 B1 that horizontally extending spring arms, whose one end is fastened to a crosswise rod and the other end is pressed with a certain spring tension against a vertical supporting bar, are provided for holding longitudinal bars that are connected by individual crosswise rods. The supporting bar additionally exhibits two horizontally protruding pins that are superimposed such that they flush with each other along a vertical plane. If the supporting bar is arranged such that the spring arm is pressed between both pins against the supporting bars, the supporting bar stably holds the reinforcement and cannot be vertically drawn out. If the supporting bar is turned by an angle of approximately 90°, the pins cease to surround the spring arm both from above and below and the supporting bars can be removed.

The disadvantage of this known process is that, on the one hand, the supporting bars 108 have to be manually suspended into the drill-holes 107 in the reinforcement support beams 106, and on the other hand, the reinforcement cages 101 also have to be manually attached to the supporting bars 108.

Furthermore, the position of the supporting bars 108, and thus, the position of the reinforcement cages 101 suspended at the supporting bars 108 can be set along the transverse direction only in the spatial pattern specified by the position of the drill-holes 107 in the reinforcement support beams 106.

Furthermore, prior to being inserted into the casting mould 100, the reinforcement cages 101 that are suspended at the supporting bars 108 are usually dipped in a bath containing rust-proofing agents to avoid corrosion in the finished structural component. The supporting bars 108 are also forced to submerge at least partly into the immersion bath. Constant accumulation of the rust-proofing layer on the rods 108 must be prevented to ensure their reuse. The size of the loop-like fasteners is adapted to the diameter of the supporting bars 108 so as to keep the depth of entry of the supporting bars into the loop-like fasteners as little as possible. Therefore, prior to the attachment of the reinforcement cages 101 to the supporting bars 108, the supporting bars 108 are usually dipped into paraffin in an additional upstream processing step. As a consequence, permanent adherence of the rust-proofing agent to the supporting bars 108 is prevented. After each production process, the paraffin and the rust-proofing agent must be removed again from the supporting bars 108 in an additional processing step. Alternatively, other pins or hooks, which have to be replaced by the correct supporting bars 108 after the dipping process, are used for dipping the reinforcement cages 101. In any case, at least an additional processing step is necessary for the protection of the supporting bars 108, leading to time and cost-related disadvantages.

SUMMARY OF THE INVENTION

An object of the present invention is to provide a process for the production of cellular or foamed concrete bodies incorporating reinforcements that are preferably made of steel, wherein the process is simple, economical and automatable and facilitates accurate and stable positioning of the reinforcement with better variability, especially along the transverse direction of the casting mold.

Furthermore, it is an object of the invention to produce a reinforcement support frame, which serves the purpose of holding the reinforcement in the cast moulding filled with fresh concrete slurry and to which the reinforcement can be attached in a simple, quick and safe manner.

According to a preferred embodiment of the process of the present invention, the part of the supporting bar positioned above a predetermined breaking point is rotated about a vertically positioned longitudinal axis of the bar with the help of an automatable turning device that includes, for example, one or more power screwdrivers. For the purpose of turning, especially the upper part of the supporting bar is attached to a drill chuck of a screwdriver and subsequently, the power screwdriver is actuated to perform the turning function.

In the process according to the invention, the separated upper part of the supporting bar is drawn out of the cast concrete block and removed, thereby serving its purpose.

The supporting bars are preferably welded to the reinforcements before use of the latter.

The supporting bars are preferably provided with a tapered cross-section at the breaking point. They additionally include at least one, preferably two oppositely positioned notches at the predetermined breaking point. Furthermore, supporting bars, which exhibit a diameter of 4 to 10 mm, preferably 5 to 8 mm, are used.

The provided supporting bars are preferably composed of metals, preferably steel, especially stretched reinforcing steel and/or stainless steel and/or plastic. Furthermore, the supporting bars are preferably an extended component of a crosswise rod of the reinforcement. Reinforcements and/or reinforcement mesh and/or reinforcement cages are used as structural reinforcements. Prior to use, the reinforcement mesh are preferably produced by welding longitudinal and transverse reinforcements, whereas each of the reinforcement cages is produced from two reinforcement mesh respectively. The reinforcement mesh are positioned with their longitudinal and transverse reinforcements parallel to each other as well as the supporting bars of each of the reinforcement mesh are positioned such that all of the supporting bars in that particular reinforcement mesh face the same side and preferably project beyond the reinforcement cage structure to more or less the same length. The simple rod-like spacers, which are aligned perpendicularly to the longitudinal and transverse reinforcements of the reinforcement mesh, are preferably interposed between two reinforcement mesh (1) and welded to them. Prior to use of the reinforcements, the supporting bars are in particular attached in the form of extended crosswise rods to the reinforcements, whereby in case of reinforcement mesh, the supporting bars are preferably welded to the longitudinal reinforcements of the reinforcement mesh.

The upper part of the supporting bar is conveniently separated at the area of the upper or lower longitudinal rod of the reinforcement mesh or cage respectively.

Furthermore, in the process according to the invention, the reinforcements provided with supporting bars are preferably inserted into an aligning or positioning device, which exhibits a horizontal and preferably rectangular base plate. The aligning or positioning device, is preferably a displaceable aligning trolley with four wheels, e.g. rail wheels at the bottom side of the base plate. Furthermore, the aligning or positioning device, preferably exhibits two exterior support walls that extend vertically and are parallel not only to each other but also along a longitudinal horizontal direction, as well as at least one, preferably 2 to 20, more preferably 3 to 8 interior support walls, which interpose the exterior support walls in a parallel manner. The support walls can be displaced, especially adjusted and automatically programmed along the transverse horizontal direction. Furthermore, the used aligning or positioning device, respectively, conveniently exhibits a stop or thrust-bearing collar/wall, which extends along the transverse direction and is arranged at one of the two transverse sides of the base plates. Furthermore, the used aligning or positioning device, respectively, preferably exhibits at least a centering mechanism for centering and positioning the reinforcement support frame with respect to the aligning or positioning device.

For the purpose of aligning and positioning the reinforcements, a reinforcement with perpendicularly and upwardly-pointing supporting bars is conveniently interposed between each pair of support walls and preferably placed on the horizontal and plane, upper side of the base plate, whereby after insertion, each of the reinforcements is aligned along the transverse direction and fixed in the preferred position by means of displacement of the support walls. Prior to insertion of the reinforcement, the aligning or positioning device, respectively, is preferably tilted by an angle of about 30 to 55°, preferably 45° around an axis parallel to the longitudinal direction and subsequently tilted back to its initial position after reinforcement insertion. Furthermore, the reinforcements are preferably pushed along the longitudinal direction against the end stop for the purpose of positioning.

The aligning trolley with the aligned and fixed reinforcements is preferably driven to the reinforcement support frames or the reinforcement support frame is transferred to the aligning or positioning device with the aligned and fixed reinforcements.

Furthermore, the reinforcement support frame used according to the invention preferably exhibits a counter-centering mechanism corresponding to the centering mechanism of the aligning and positioning device. Furthermore, preferably for gripping of the reinforcement that is aligned and fixed in the aligning and positioning device, the used reinforcement support frame is lowered e.g. by means of a crane to the top of the aligning and positioning device such that the longitudinal and the transverse beams of the reinforcement support frame are aligned in a parallel and perpendicular manner to the support walls of the aligning trolley respectively. The reinforcement support frame is positioned along the horizontal direction by means of the centering and counter-centering mechanisms while being lowered with respect to the aligning and positioning device as well as the reinforcements.

The reinforcement support frame is preferably removed from the aligning and positioning device after the ends of the supporting bar are clamped to the reinforcements and then the reinforcement structure is optionally dipped in an immersion bath with rust-proofing agents. Subsequently, or immediately after clamping, the reinforcement support frame is transferred along with the suspended reinforcements to the casting mould and placed above the same such that the suspended reinforcements dip into the casting mould.

The cast concrete block is conveniently released from the casting mould before or after the separation and removal of the upper part of each of the supporting bars.

Further features and advantages of the invention will be apparent from the claims and description that follows.

BRIEF DESCRIPTION OF THE DRAWINGS

The invention is illustrated in further details in the following drawings. The drawings show.

DETAILED DESCRIPTION OF THE INVENTION

Figure 1:
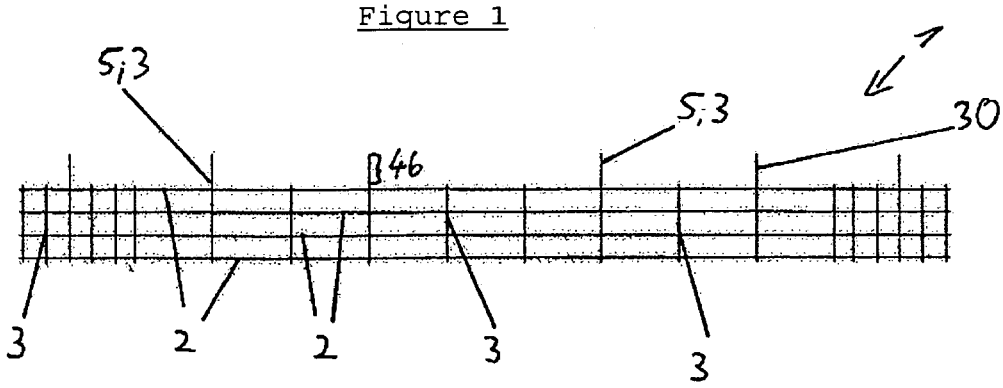
FIG. 1 is a side view of a reinforcement mesh with supporting bars.
Figure 8:
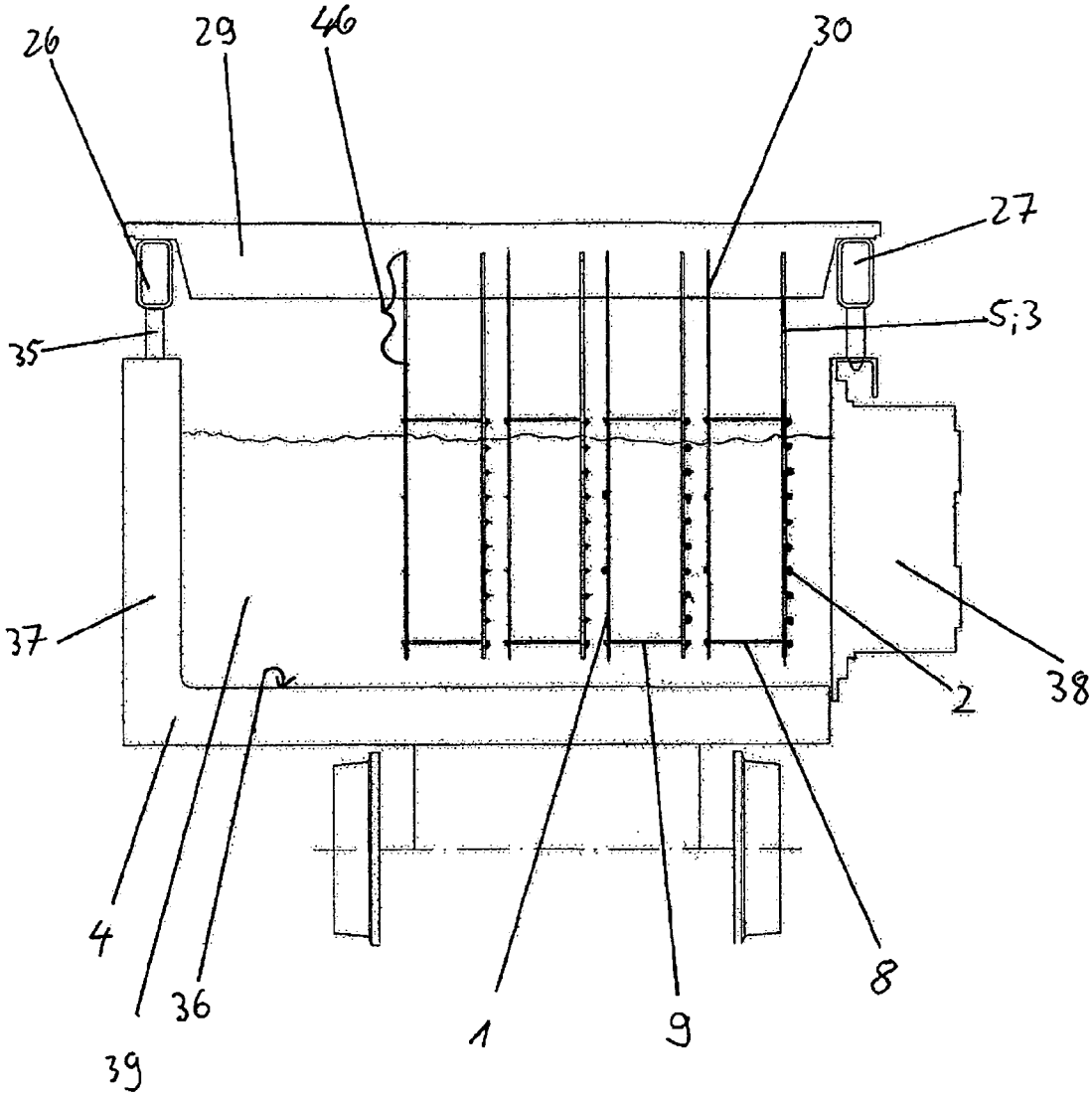
FIG. 8 is a schematic cross-sectional view of a casting mould with superimposed reinforcement support frame according to an embodiment of the invention, and reinforcement cages hanging into the casting mould.
Figure 9:
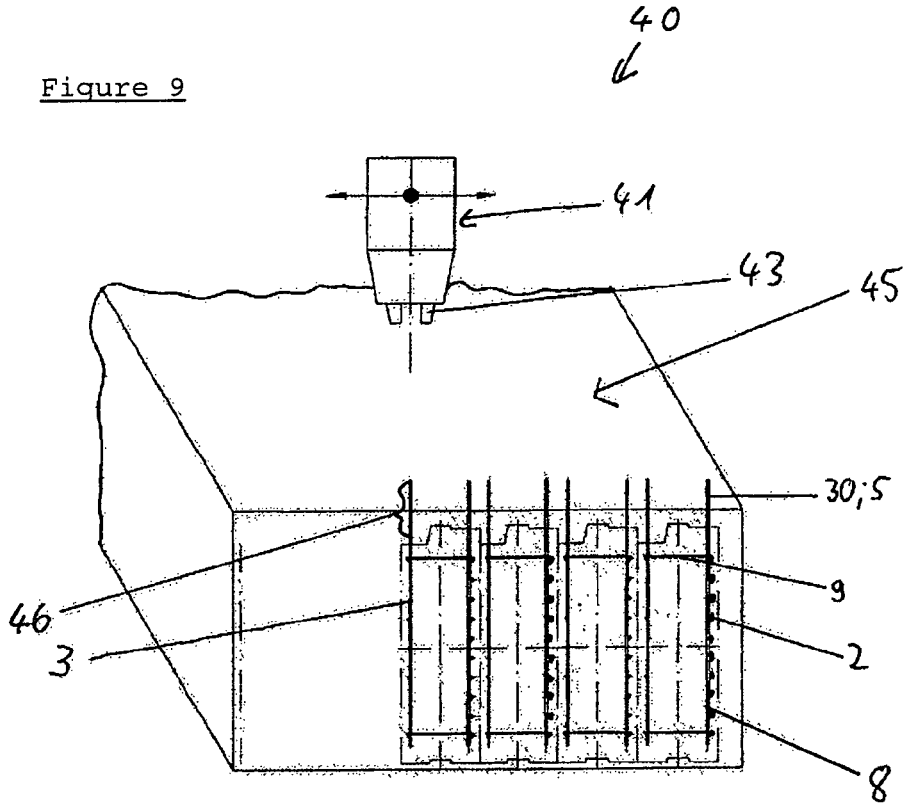
FIG. 9 is a perspective cross-sectional view of a concrete block that is cast and released from the casting mould according to an embodiment of the invention, with a schematically illustrated power screwdriver.
Figure 10:
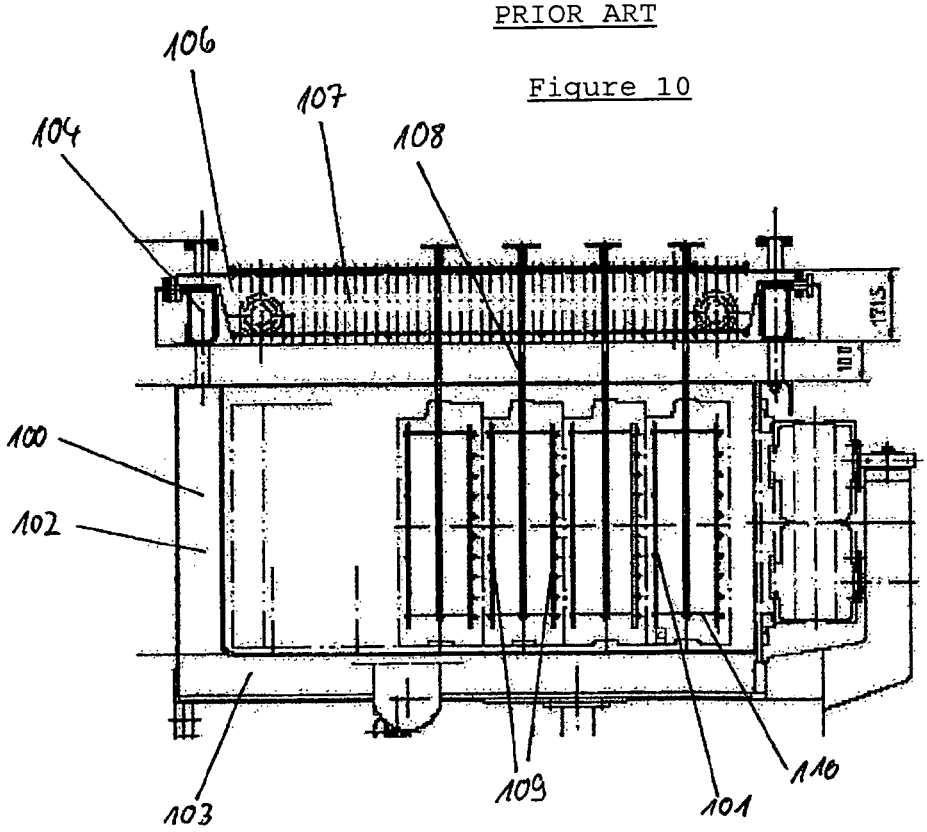
PRIOR ART Figure 10
FIG. 10 is a schematic cross-sectional view of a casting mould with superimposed reinforcement support frame and suspended reinforcement cages according to prior art technology.

In the manufacturing process according to the invention, reinforcement mesh 1 (FIG. 1) can be produced by well-known automatic mesh welders (not illustrated) from longitudinal 2 and transverse reinforcements 3, which cross themselves in pairs. Transverse reinforcements 3 refer to the reinforcements of the reinforcement mesh 1 that are vertically aligned when the suspended reinforcement mesh 1 dip into the cast moulding 4 (FIG. 8), and thus, provide for an interconnection and stable positioning of the longitudinal bars 2 of the reinforcement mesh 1 that are horizontally aligned and vertically superimposed in flush with each other as well as ensure an increase of the tensile strength and bending strength of the finished structural component.

Preferably already during welding the reinforcement mesh 1 for the purposes of the invention, supporting bars 5 (FIGS. 1, 4, 5, 8 and 9) are preferably welded in the form of extended transverse bars 3 to the reinforcement mesh 1, in particular, the longitudinal bars 2 of the reinforcement mesh 1, so as to firmly connect the supporting bars 5 to the reinforcement mesh 1. Thus, each of the supporting bars 5 consists of a usual transverse bar 3 of normal length and an additional area of suspension that is provided at the transverse bar 3. The supporting bars 5 have a length such that along the vertically upward direction they project beyond the reinforcement mesh 1 (FIG. 1), which subsequently will be positioned in the casting mould 4 by a specified distance, especially 50 to 400 mm, preferably 180 to 200 mm.

As an alternative to welding, the supporting bars 5 are attached to the reinforcement mesh 1 by means of sleeves and/or clamps and/or support brackets.

The supporting bars 5 can be also attached to externally obtained reinforcements of cellular and/or foamed concrete bodies.

Figure 2:
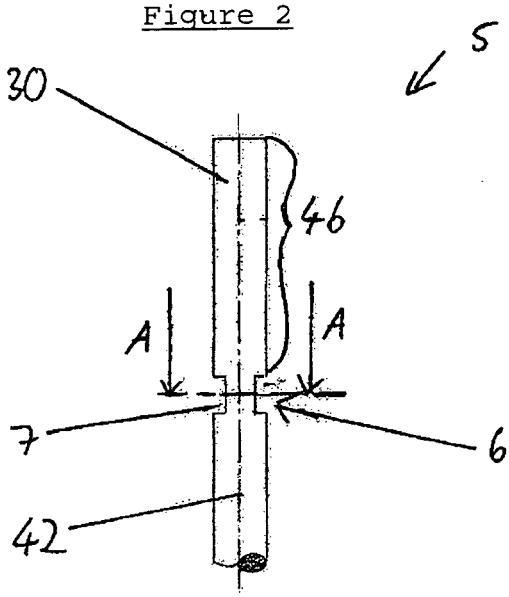
FIG. 2 is a side view of a supporting bar with a predetermined breaking point.
Figure 3:
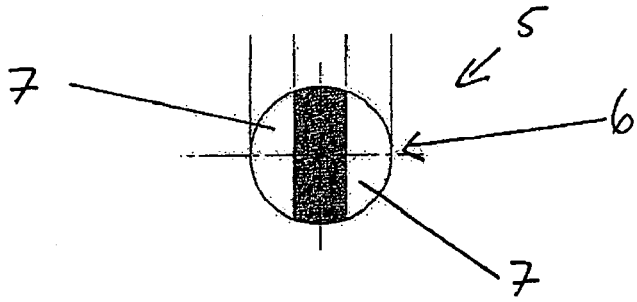
FIG. 3 is a cross-section of the supporting bar taken along the line A-A according to FIG. 2.
Figure 4:
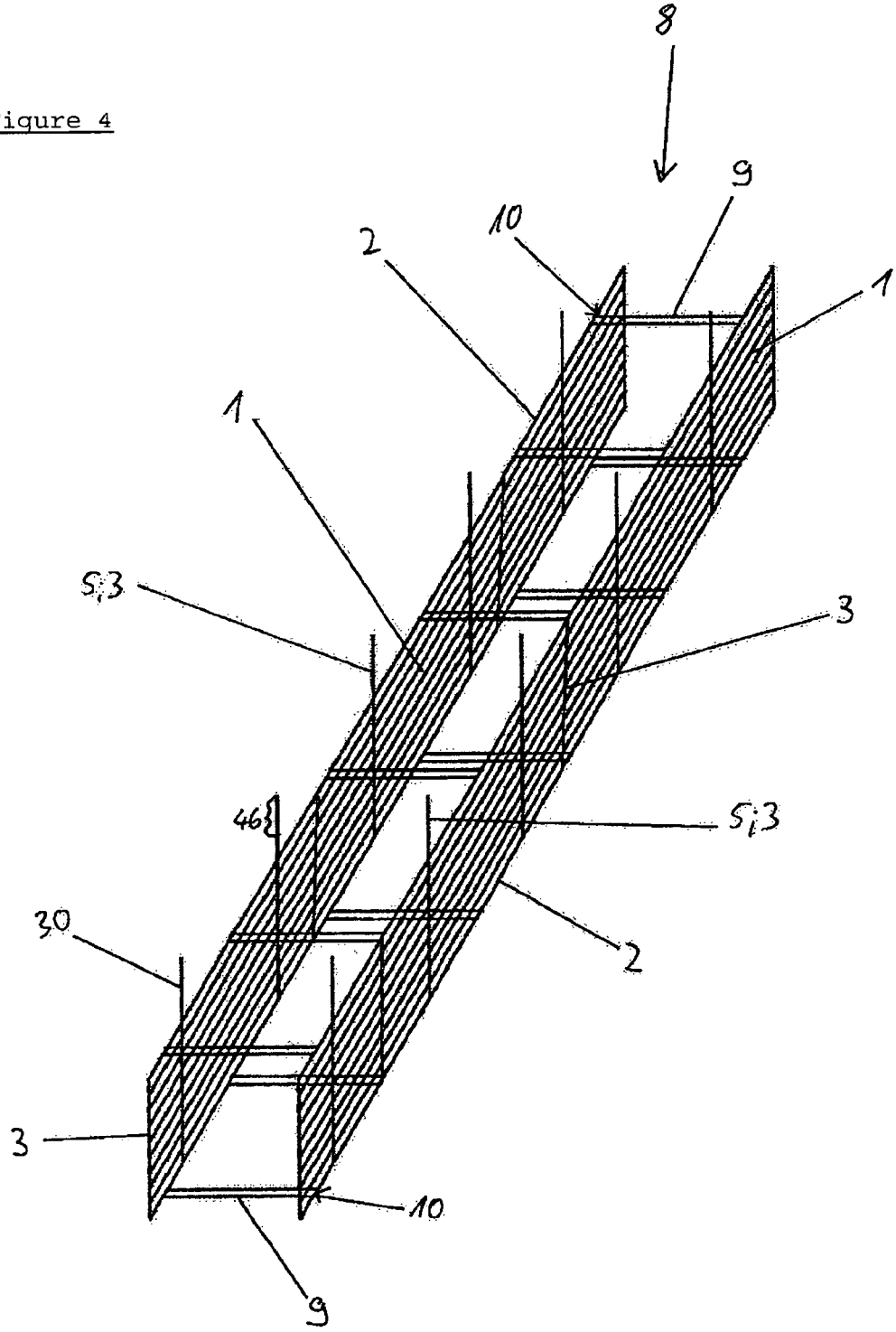
FIG. 4 is a perspective view of a reinforcement cage made from two reinforcement mesh.
Figure 5:
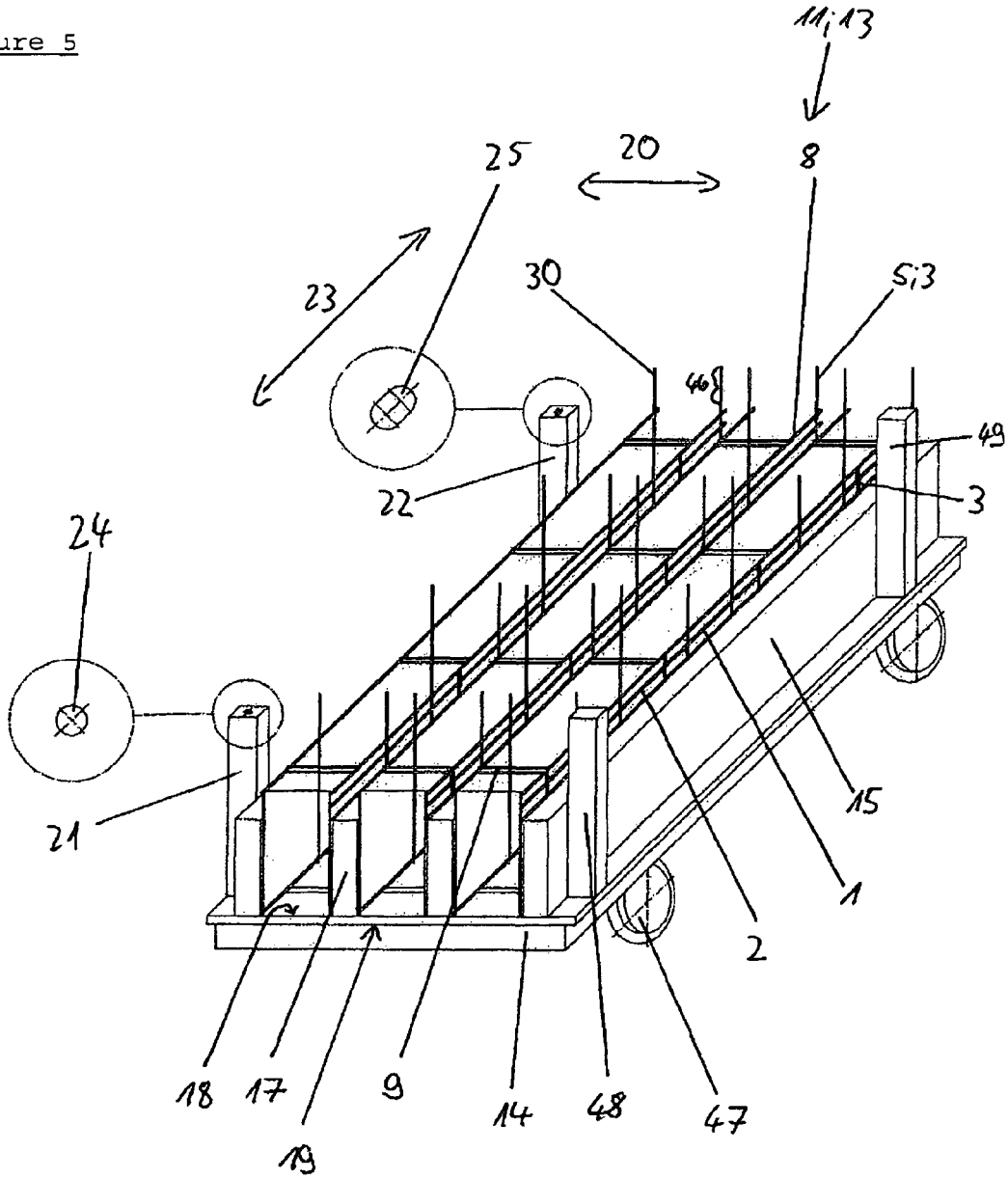
FIG. 5 is a schematic and perspective view of the front side of an aligning and positioning device.

The supporting bars 5 preferably exhibit a predetermined breaking point 6 with e.g. at least one, preferably two opposed notches 7 (FIGS. 2 and 3), so as to form a tapered cross-section of the supporting bars 5 at the predetermined breaking point 6. The predetermined breaking point 6 is conveniently arranged slightly above the topmost longitudinal bar 2 of the reinforcement mesh 1.

Alternatively, the supporting bars 5 are only constricted or pressed together or weakened by other means at the predetermined breaking point 6.

Two to 8, especially 5 to 6 supporting bars 5 are advantageously provided per reinforcement mesh 1, whereby a reinforcement mesh 1 has an appropriate length of 1 to 8 m, preferably 2 to 6.5 m.

Furthermore, the supporting bars 5 exhibit a diameter of 4 to 10 mm, preferably 5 to 8 mm and are preferably made of steel, especially stretched reinforcing steel and/or high-grade steel and/or plastic.

Furthermore, each one of the reinforcement cages 8 (FIGS. 4, 5, 8 and 9) can be produced appropriately from two reinforcement mesh 1, respectively, in the current process according to the invention. In addition, the reinforcement mesh 1 are positioned with their longitudinal and transverse bars 2; 3 parallel to each other and e.g. simple rod-like spacers 9, which are aligned perpendicular to the longitudinal and transverse bars 2; 3 of the reinforcement mesh 1, are interposed between two reinforcement mesh 1 to be connected and are welded to the reinforcement mesh 1 with both of the front sides of the rod-like spacers 10. Alternatively, spacers made of metal or plastic can also be clamped. The supporting bars 5 of each of the reinforcement mesh 1 are positioned such that all of the supporting bars in that particular reinforcement mesh face the same side and preferably project beyond the reinforcement cage structure to more or less the same length.

Figure 6:
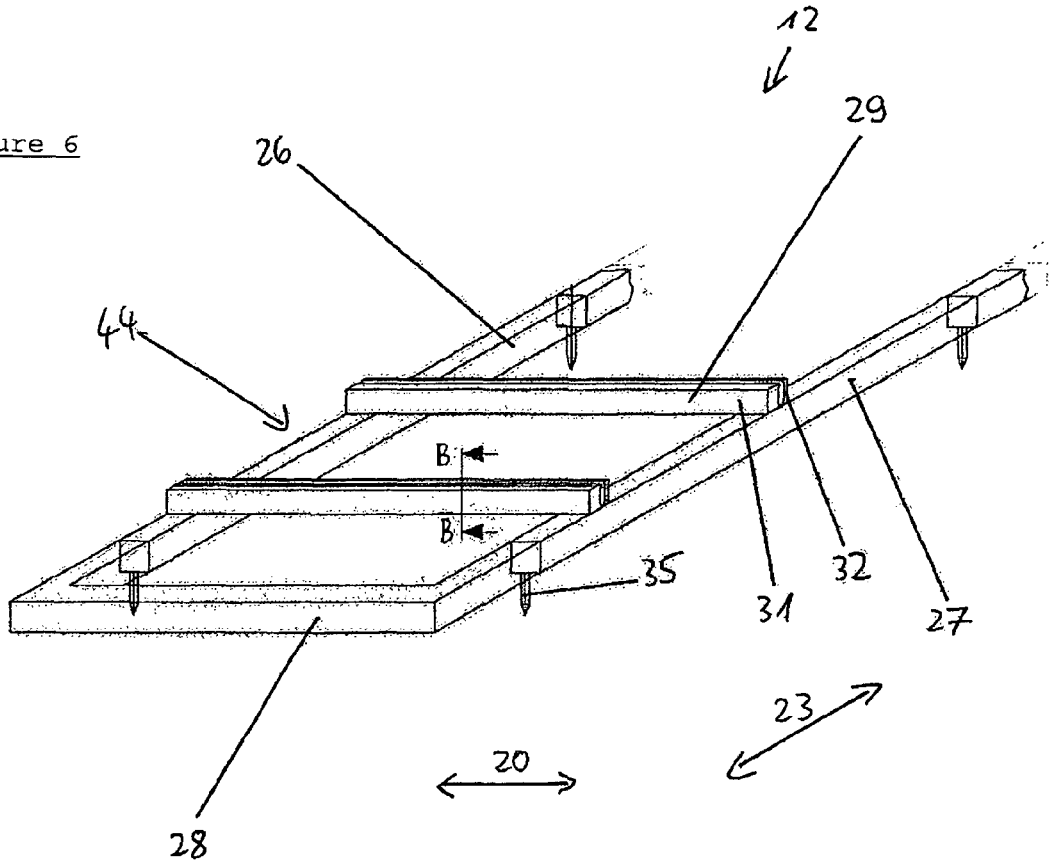
FIG. 6 is a schematic and perspective view of the front side of a part of a reinforcement support frame according to an embodiment of the invention.

According to the invention, the fabricated reinforcement cages 8 provided with supporting bars 5 are placed in an aligning or positioning device 11, respectively (FIG. 5), in which they are positioned and aligned for being supported by a reinforcement support/suspension frame 12 (FIGS. 6-8), which will be described below.

The aligning or positioning device 11, respectively, that resembles e.g. a trolley preferably exhibits a horizontal, essentially rectangular base plate 14, whose lower side has four wheels 47, e.g. rail wheels attached to it. As a result, the aligning or positioning device 11, respectively, preferably is a displaceable, aligning trolley and/or shuttle 13. Furthermore, the aligning or positioning device 11, respectively, preferably exhibits two exterior support walls 15 that extend vertically and are parallel not only to each other but also along a longitudinal horizontal direction 23, as well as at least one, preferably 2 to 13, more preferably 3 to 6 interior support walls 17, which interpose the exterior support walls 15 in a parallel manner. The support walls 15; 17 serve to align the reinforcement cages 8 along a horizontal transverse direction and can be displaced, in particular, adjusted and automatically programmed preferably along the transverse horizontal direction 20.

A stop or thrust-bearing collar/wall or the like (not illustrated), which extends along the transverse direction 20 vertically upwards from an upper side 18 of the base plate 14 and is arranged at one of the two transverse sides 19 of the base plates, is provided for the positioning of the reinforcement cages 8 along the transverse horizontal direction 20.

Furthermore, the used aligning or positioning device 11, respectively, exhibits at least one, preferably two, vertically aligned centering beams 21; 22 as well as, preferably two, positioning beams 48; 49, both of which serve to center and position the reinforcement support frame 12 with respect to the aligning trolley 13 that is later dealt with in detail. For this purpose, the centering beams 21; 22 are aligned in flush with each other preferably along the longitudinal direction 23, arranged exterior to one of the outer and longitudinal support walls 15 of the aligning or positioning device 11, respectively, as well as dimensioned such that they 21; 22 protrude above the support walls 15 along the vertical direction. The positioning beams 48, 49 are similarly aligned in flush with each other preferably along the longitudinal direction 23, arranged exterior to the other outer and longitudinal support wall 15 of the aligning or positioning device 11, respectively, and as well as dimensioned such that they protrude above the support walls 15 along the vertical direction. The centering and positioning beams 21; 22; 48; 49 are preferably of the same height. The centering bars 21; 22 additionally exhibit a vertical centering hole 24, 25, at the front side and upper side respectively, whereby one of the centering holes 24 is preferably designed as a cylindrical hole and the other centering hole 25 as a slotted hole extending itself along the longitudinal direction 23. In case of a layout with only one centering beam, the centering hole is preferably designed polygonal, especially rectangular cross-section (not illustrated).

For the purpose of aligning and positioning the reinforcements 8, a reinforcement 8 with perpendicularly and upwardly-pointing supporting bars 5 is interposed between each pair of support walls 15; 17 and placed on the horizontal and plane, upper side 18 of the base plate 14. The reinforcement cages 8 and the supporting walls 15; 16 are dimensioned such that at least the supporting bars 5 protrude above the support walls 15; 16 along the vertical direction.

After insertion, each of the reinforcement cages 8 is aligned and fixed at the preferred position by displacement of the support walls 15; 17 along the transverse direction 20. The positioning of the reinforcement cages 8 along the longitudinal direction 23 takes place by pushing the reinforcement cages 8, which are interposed between the support walls 15; 17, along the longitudinal direction 23 against the stop collar. Each of the reinforcement cages 8 is pushed either manually by hand or by means of a sliding device, provided for this purpose, e.g. a crane, manipulator or a robotic arm, which engages with e.g. the protruding supporting bars 5.

The reinforcement cages 8 are automatically positioned along the vertical direction by placing on the upper side 18 of the base plate 14.

Alternatively, prior to the insertion of the reinforcement cages 8, the aligning or positioning device 11, respectively, is tilted preferably by an angle of about 30 to 55°, more preferably 45° around an axis parallel to the longitudinal direction 23. As a consequence, the reinforcement cages 8 automatically slide down along one of the support walls 15; 17 due to the force of gravity and thus, get automatically positioned with respect to both vertical and transverse directions 20. The alignment along the longitudinal direction takes place similar to the above-mentioned manner either before or after the aligning or positioning device 11, respectively, is tilted back to its initial position.

The reinforcement cages 8 are horizontally and vertically aligned and positioned corresponding to their subsequently preferred position in the casting mould 4. This preferred position in the casting mould is specified by the preferred position in the cast structural components. The positioned reinforcement cages can then be held by the reinforcement support frame 12 in the next step.

The reinforcement support frame 12 (FIG. 6-8) preferably has a rectangular shape and exhibits an external frame (44) having two horizontally-extending longitudinal beams 26; 27 and two transverse bars 28 (only one of which is illustrated) that likewise extend horizontally and are perpendicular to the longitudinal beams 26; 27. The reinforcement support frame 12 additionally exhibits at least one, preferably 2 to 8, more preferably 5 to 6 reinforcement suspension and/or support beams 29, which span across the external frame 44 along the transverse horizontal direction 20 in a bridge-like manner, as well as connected with the external frame 44, preferably in a linearly displaceable manner along the longitudinal horizontal direction 23. For example, the reinforcement support beams 29 are attached to the longitudinal beams 26; 27 by means of screws or clamps.

According to the invention, each of the reinforcement support beams 29 or one or more of the exterior frame elements (26; 27; 28) are at least provided with a clamping element and/or mechanism, with which one or more supporting bars 5 can be gripped, clamped and supported at their upper end or terminal area 30 (FIGS. 1, 2, 4, 5 and 7-9) that projects beyond the reinforcement cages 8 and the aligning trolley 13.

The clamping equipment are e.g. two vertically aligned clamping means 31; 32 (FIGS. 6 and 7), which are made of e.g. metal or plastic and aligned along the longitudinal direction 23 of the reinforcement support frame 12 in flush and closely spaced to each other, as well as at least one of which, can be displaced with respect to the other along the longitudinal direction 23 of the reinforcement support frame 12. As a result, a clamping gap 33, whose width can be adjusted and which is open at the bottom and preferably, also at the top, is defined between the two clamping bars 31; 32. If the two clamping bars 31; 32 are designed and laid out such that the clamping gap 33 is also open at the top, the length tolerances of the supporting bars 5 to be inserted into the clamping gap 33 are irrelevant.

The length of the clamping bars 31; 32 is preferably dimensioned such that they essentially extend along the entire length of the reinforcement support beam 29.

Figure 7:
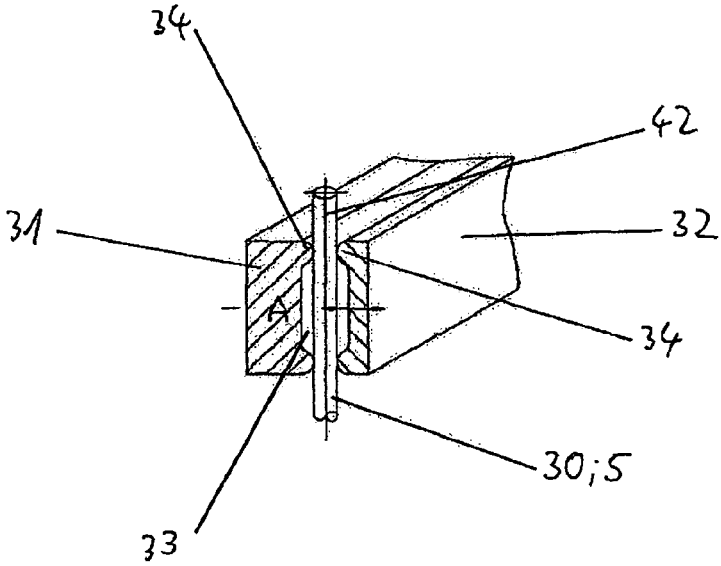
FIG. 7 is a schematic and perspective cross-sectional view of the reinforcement holding bars of the reinforcement support frames according to the FIG. 6, taken along the line B-B.

Furthermore, each one of the two clamping bars 31; 32 preferably exhibits two superimposed beads 34, which extend along the transverse direction and protrude into the clamping gap 33, whereby the beads 34 of the two clamping bars 31; 32 are arranged in pairs of oppositely positioned beads, thereby constricting the clamping gap 33 in these areas (FIG. 7). Thus, the supporting bars 5 are clamped only between two oppositely facing beads 34, as a result of which, the clamping force is increased.

The displacement and fixation of the clamping bars 31; 32 with respect to each other takes place by means of spring tension and/or pneumatically and/or hydraulically, whereby the clamping force is adjustable.

As opposed to the clamping bars 31; 32, the clamping devices are individual grippers having two holding clamps which can be moved towards each other for clamping the ends of the supporting bar 30, as well as preferably displaced along the transverse direction 20 along the relevant reinforcement support beam 29, whereby several grippers are provided per reinforcement support beam 29 (not illustrated).

Furthermore, the reinforcement support frame 12 exhibits at least one, preferably two centering pins 35 that extend vertically downward. The centering pins 35 are preferably arranged below the longitudinal beams 27, whereby both of them are preferably intended at a single longitudinal beam 27. Furthermore, both centering pins 35 are positioned and designed with respect to the centering holes 24; 25 of the aligning and positioning device 11. In particular, the upper area of the centering pins 35 is designed to have a rectangular or polygonal cross-section or cylindrical shape depending upon the layout of the corresponding centering holes 24, 25.

For gripping of the reinforcement cages 8 that are aligned and fixed in the aligning and positioning device 11, the reinforcement support frame 12 is lowered e.g. by means of a crane to the top of the aligning and positioning device 11 such that the longitudinal 26; 27 and transverse beams 28 of the reinforcement support frame 12 are aligned in a parallel and perpendicular manner to the support walls 15; 17 of the aligning trolley 13, respectively. In the layout of the aligning and positioning device 11 as an aligning trolley 13, the latter along with positioned and fixed reinforcement cages 8 is at first driven e.g. on rails to the reinforcement support frame 12, thereby increasing flexibility and substantially simplifying the process.

The exact horizontal centering and positioning of the reinforcement support frame 12 with respect to the aligning and positioning device 11 and thus, the reinforcement cages 8, takes place by insertion of the centering pins 35 into the centering holes 24; 25 during lowering of the reinforcement support frame 12. By means of the centering pins 35 and the corresponding centering holes 24; 25, the reinforcement support frame 12, in particular, the reinforcement support beams 29 with the clamping bars 31; 32, as well as the reinforcement cages 8 are positioned to each other such that the ends of the supporting bar 30 are introduced into the clamping gaps 33 during the lowering of the reinforcement support frame 12.

The vertical positioning of the reinforcement support frame 12 takes place by the placement of the reinforcement support frame 12 on the centering 21; 22 as well as the positioning beams 48; 49.

After the reinforcement support frame 12 has attained its specified position along the vertical direction, the clamping bars 31; 32 are correspondingly moved towards each other and the ends of the supporting bars are clamped between these clamping bars.

As a consequence, the supporting bars 5 and thus, each of the reinforcement cages 8 is rigidly connected to the reinforcement support beam 29 of the reinforcement support frame 12 such that their relative displacement or rotation along both horizontal as well as vertical directions is prevented. Thus, the reinforcement cages 8 are tightly clamped to the reinforcement support frame 12 in a displacement and torque-proof, however, detachable manner.

Finally, the aligning trolley 13 together with the reinforcement support frame 12 as well as the reinforcement cages 8 can be optionally driven to a known rust-proofing immersion equipment (not illustrated) or the reinforcement support frame 12 together with the suspended reinforcement cages 8 can be lifted from the aligning and positioning device 11 by means of a crane and optionally transferred to the immersion equipment. The use of continuous chain conveyors is also possible. In the rust-proofing immersion equipment, the raised reinforcement cages 8 are dipped into an immersion bath with rust-proofing agents. The supporting bars 5 are also forced to at least partly submerge in the immersion bath. Alternatively, the reinforcement cages 8 are sprayed with rust-proofing agents. The reinforcement cages 8 are not treated with the rust-proofing agents upon use of stainless steel. Alternatively, the reinforcement cages can be coated with the rust-proofing agents before being inserted and positioned in the aligning trolley 13.

After the optionally used rust-proofing immersion equipment, the reinforcement support frame 12 along with the reinforcement cages 8 are preferably transported by means of a crane to, any, preferably rectangular, casting mould 4 (FIG. 8) with an open top and placed on it in such a manner that the suspended reinforcement cages 8 dip into the mould 4. In particular, the longitudinal and transverse beams 26; 27; 28 of the reinforcement support frame 12 are placed on two vertical longitudinal walls 37; 38 and two vertical transverse walls (not illustrated) of the casting mould, respectively. The positioning of the reinforcement support frame 12 and thus, the reinforcement cages 8 in the casting mould 4 takes place in a manner by means of centering pins 35, which are provided at the reinforcement support frame 12 and introduced into appropriate centering recesses (not illustrated) in the longitudinal walls 37; 38 of the casting mould. It is hereby important to note that the suspended reinforcement cages 8 are sufficiently separated from both the horizontal base of the casting mould 36 as well as the longitudinal walls 37; 38 and transverse walls of the casting mould. Furthermore, the reinforcement cages 8 must be suspended such that they sufficiently dip into the casting mould 4 and remain sufficiently below the surface of the eventually expanded cast concrete block, thus, resulting in the complete enclosure of the reinforcement cages 8 by the concrete cover.

The filling of the fresh concrete slurry 39 into the casting mould 4 can take place before or after the suspension of the reinforcement cages 8 into the casting mould 4. Cast structures of cellular concrete are produced by using fresh concrete slurry 39, which exhibits at least a swelling pore-former, in particular, particulate aluminium e.g. in the form of aluminium powder or paste. Fresh concrete slurry that already contains entrapped air spaces is used for the production of cast structures of foamed concrete.

After filling of the fresh concrete slurry 39 and the insertion of the reinforcement cages 8, the fresh concrete slurry 39 is allowed to initially set and/or optionally expand through hydration for approximately 30 to 240 minutes, until the fresh concrete slurry 39 has attained a sufficient green strength and a fresh concrete block 40 (FIG. 9) has developed.

After reaching the green strength, the supporting bars 5 and/or at least the upper parts 46 of the supporting bars 5 are detached and removed from the reinforcement cages 8 in accordance with the invention. The upper ends 46 of the supporting bars 5, namely, the parts 46 above the predetermined breaking point 6 are merely turned in case of notched supporting bars 5, namely, those provided with a predetermined breaking point 6. For the purpose of detachment, at first e.g. the clamping of the upper end of the supporting bar 30 is loosened or completely disengaged by moving the clamping bars away from each other. If necessary, the reinforcement support frame 12 is lifted and removed from the casting mould 4 by means of e.g. a crane. Subsequently, the ends of the supporting bar 30 are engaged, e.g. similarly clamped, and the upper part of the supporting bar 46 is rotated about a longitudinal vertical axis of the bar 42 (FIGS. 2 and 7) to such an extent that the upper part separates from the rest of the supporting bar 5 at the predetermined breaking point 6. The lower parts of the supporting bars 5 are rigidly connected, specifically welded to the reinforcement cages 8 to such an extent that they are not turned along with the upper parts 46 of the supporting bars around the longitudinal axis of the rod 42. The separated upper part 46 of the supporting bar is then pulled out and removed from the cast concrete block 40.

The turning of the upper parts 46 of the supporting bars preferably takes place by means of an automatable turning device. This can be accomplished, for example, by use of one or more power screwdrivers 41 (FIG. 9), in whose drill chucks 43, the supporting bar ends 30 are clamped and then the power screwdrivers 41 are actuated to perform the turning function.

As an alternative to turning, the supporting bars 5 can be bent and broken and/or pulled apart and/or clipped off and/or scraped off at the breaking point.

After a separation, the upper parts 46 of the supporting bars 5 are at first bent by an angle of preferably 90° and then the bent parts 46 of the supporting bar 5 are turned around the longitudinal axis of the rod 42, until the supporting bars 5 break up at the predetermined breaking point 5. Bending and subsequent turning are carried out simultaneously, namely, in an automated manner for all supporting bars 5. Preferably, the individual supporting bars 5 of a reinforcement cage 8 are bent and turned in an alternating manner, namely every pair of the supporting bars 5 of a reinforcement cage 8 are bent and turned in opposite directions, so as to reciprocally cancel out the forces acting upon the reinforcement cage 8. As a consequence, the anchorage of the reinforcement cage 8 in the cast concrete block 40 is not affected.

The predetermined breaking point 6 of the supporting bars 5 preferably lies below, above or at the height of an upper surface 45 of the cast concrete block 40. In particular, the predetermined breaking point 6 of the supporting bars 5 lies slightly above the upper longitudinal reinforcements 2 of the reinforcement cages 8 or slightly below the surface of the later construction component as described above. As a result, the separated lower part of the supporting bar 5 remains as a transverse bar 3 in the cast concrete block 40, thereby forming a part of the reinforcement in the later construction component.

In order to reuse the supporting bars 5 the position of the predetermined breaking point 6 can be specified considerably below, for example, in the range of the lower longitudinal bar 2, so that the separated upper parts 46 of the supporting bars are of sufficient length to be reused.

Supporting bars 5 without a predetermined breaking point 6 are cut, scraped or clipped off or bent and broken and/or similar to the above description, at first bent by an angle of 90° and subsequently turned off, e.g. above the cast concrete block 40 or at the height of an upper surface 45 of the concrete block 40.

If the entire supporting bar 5 is removed from the concrete block 40, the connection, especially the welded joint of the supporting bar 5 and reinforcement cage 8 is designed such that it holds the weight of the reinforcement cages 8 suspended at the supporting bars 5 and eventually withstands the expansion stresses due to hydration, however, is detachable e.g. by turning the entire supporting bar 5 around the longitudinal axis of the rod 42 as described above or by pulling out the supporting bars 5 or by means of vibration, so as to detach and remove the entire supporting bar 5 from the cast concrete block 40.

In a subsequent production step, the new outer part of the supporting bar 5, which is formed by turning or breaking off and remains in the cast concrete block 40, is once again provided, specifically sprayed with a rust-proofing agent.

Subsequently, the cast concrete block 40 is appropriately released from the casting mould by means of any known method, for example, by unfolding the individual sidewalls 37; 38 of the casting mould 4. Depending upon the production process, a sidewall 37 is not unfolded. This serves as the so-called hardening base 38, upon which the separated cast concrete block 40 is flipped over for subsequent hardening. Release from the casting mould can also take place before the removal of the supporting bars 5 and/or their parts 46.

As the next step, the cast concrete block 40 is appropriately partitioned into individual concrete blocks of initial consistency (not illustrated) by means of a known method, e.g. with the help of cutting wires. The cast concrete block 40 is preferably cut along the vertical direction between the reinforcement cages 8, whereby cutting appropriately takes place such that every partitioned concrete block exhibits a reinforcement cage 8. During cutting, for example, the hardness ground 38 (FIG. 8) is preferably assumed as "0" or initial point of reference.

After cutting, the partitioned concrete blocks of initial consistency are preferably led to an autoclave and hydrothermally hardened by means of any known method (not illustrated).

The non-requirement of a separate dipping of the previously used supporting bars in paraffin in an additional production step is advantageous in the process according to the invention. This is due to the fact that the supporting bars 5 according to invention are clamped from above and need not be passed through a drill-hole in the reinforcement support beams and the loop-like fasteners in a precisely fitting manner.

An additional significant advantage of the inventive clamping of the supporting bars 5 from above is that the position of the reinforcement cages 8 is continuously adjustable relative to the reinforcement support beams 12 along the transverse direction 20. As a result, the later position of the reinforcement cages 8 in the casting mould 4 can be easily and continuously adjusted in a completely variable and very accurate manner as well as optimally and easily adapted to the respective conditions. Furthermore, supporting bars 5 of any preferable diameter can be clamped without the necessity for the adjustment and/or replacement of the reinforcement support beam 12.

Furthermore, on account of the stable and integrated connection of the supporting bars 5 and reinforcement cages 8, it is ensured that the reinforcement cages 8 can be very accurately aligned and positioned in the casting mould 4 and also remain fixed while pouring and eventual expansion of the fresh concrete slurry 39. The reinforcement cages 8 can withstand very large expansion stresses. Thus, the tolerances in the position of the reinforcement structure in the manufactured construction component are very small.

The complete production process is fully automatable by using the automatically controllable and programmable aligning trolley 13 and the subsequent automated gripping and clamping of the positioned supporting bars 5 from above by means of the clamping means that are provided at the reinforcement support beams 12, as well as the optionally automatic, at least partial separation of the individual supporting bars 5. There is no necessity for manual suspension of the supporting bars at the reinforcement support beams 29 as well as manual suspension or tying up of the reinforcement cages 8 through the loop-like fasteners at the supporting bars. On the one hand, this is accompanied by substantial time and cost reduction and on the other, the reinforcement cages 8 are not contacted after being coated with the rust-proofing agents, thus enabling the intactness of the rust-proofing layer. Furthermore, the automatic alignment of the reinforcement cages 8 by means of the aligning trolley 13 is very accurate.

The very short tolerance range in the process according to invention is especially advantageous, since the clamping means do not introduce any additional tolerance and the supporting bars 5 are rigidly connected, namely in a displacement and torque-proof manner, both with the reinforcement cages 8 as well as the reinforcement support frame 12, while being suspended into the casting mould 4 and until the cast concrete slurry 39 reaches its green strength.

The process according to invention is not only applicable to reinforcement cages 8, but primarily all kinds of reinforcement means. Structural reinforcements, in the context of this application, are all those known to those skilled in the art, especially reinforcements, reinforcement mesh, reinforcement cages and/or loop-like fasteners and/or installation anchors, whereby the reinforcements, reinforcement mesh and reinforcement cages can exhibit a variety of shapes, namely, even spatially curved shapes. The supporting bars are fastened directly to the reinforcements upon their use.

Furthermore, the manufactured cast concrete bodies or blocks can also exhibit any rectangular shape as well as e.g. a cylindrical, hemispherical or prismatic three-dimensional shape that can be produced with the help of a casting mould that is open at the top. Only the form of the reinforcement support frame is adapted according to the thereby resulting three-dimensional shape of the casting mould, so as to exactly superimpose the reinforcement support frame on the casting mould.

In the case of reinforcement mesh and reinforcement cages composed of several reinforcement mesh, it is advantageous due to the fact that a part of the normally intended transverse reinforcements can be easily replaced by e.g. notched supporting bars, since their lower parts remain in the cast concrete block and thus, form a functional part of the reinforcement structure. In this case, supporting bars are merely extensions of the transverse reinforcements in terms of production techniques and can be integrated in the production process in an especially simple manner, without the necessity of other devices for the connection of the supporting bars to the reinforcements. Welding of the supporting bars is also economical due to the fact that there is no necessity for additional complicated fasteners, e.g. spacer with loop-like fasteners. Furthermore, the supporting bars are simple rods, which are preferably made of the same material or raw material of the reinforcements and do not exhibit any additional fasteners, e.g. step-wise recesses for suspending in holes in the reinforcement support frame, or parts of a bayonet closure.

In summary, the process according to the invention is very economical, since, inter alia, the process is fully automatable and ensures very accurate positioning of the reinforcements in the cellular and/or foamed cast concrete bodies or blocks.

The invention claimed is:

1. A process for the production of cellular or foamed cast concrete bodies or block that are reinforced with reinforcements made of metals, comprising the following processing steps:

(a) providing at least one reinforcement with at least one rigidly integrated supporting bar wherein each of the supporting bars comprises an upper end that projects beyond the reinforcement by a definite length and is optionally provided with a predetermined breaking point;

(b) positioning the reinforcement for being held by a reinforcement support frame, the frame including at least one clamping component; (c) gripping or clamping the end of the supporting bar by means of the clamping component such that the reinforcement is rigidly attached to the reinforcement support frame while dangling from the reinforcement support frame;

(d) applying a rust-proofing agent to the reinforcement;

(e) dipping the reinforcement which is suspended from the reinforcement support frame, into a casting mould, the mold being open at the top for receiving fresh concrete slurry;

(f) allowing initial setting of the fresh concrete slurry to form a cast concrete block, and holding the reinforcement by means of the reinforcement support frame during the initial setting;

(g) separating each upper end of each of the supporting bars from the reinforcement;

(h) optionally cutting and partitioning of the cast concrete block into cellular or foamed cast green concrete bodies; and (i) hardening the cellular or foamed cast concrete bodies or block.

2. The process of claim 1, wherein the upper end of the supporting bar is separated above or below or at the same height of an upper surface of the cast concrete block.

3. The process of claim 2, wherein, in the case of supporting bars provided with a predetermined breaking point, the part of the supporting bar that projects beyond the predetermined breaking point is rotated about a longitudinal vertical axis of the supporting bar, or bent or broken or pulled apart or clipped or scraped off.

4. The process of claim 2, wherein each of the supporting bars without a predetermined breaking point are cut or scraped off or bent above the cast concrete block.

5. The process of claim 2, wherein the upper ends of each of the supporting bars are at first bent by an angle of preferably 90°, at a bending point, to form bent parts, and subsequently the bent parts of the supporting bars are turned around the longitudinal axis of the bars, until the supporting bars break off at the bending point.

6. The process of claim 5, wherein bending and subsequent turning are simultaneously carried out for all supporting bars of a reinforcement structure, wherein the supporting bars are arranged in pairs opposing each other and the supporting bars of every pair of the reinforcement are turned and bent in opposite directions to each other.

7. The process according to claim 1, wherein the reinforcements are inserted into an aligning or positioning device.

8. The process of claim 1, wherein a reinforcement support frame is used, which is designed with a rectangular shape and having an external frame having two horizontally-extending longitudinal beams and two transverse bars that extend horizontally and are perpendicular to the longitudinal beams.

9. The process of claim 8, wherein a reinforcement support frame is used, having at least one reinforcement supporting beam that is connected to the external frame, in a linearly displaceable manner along the longitudinal horizontal direction.

10. The process of claim 8, wherein the clamping component includes clamping beams or bars which extend along the transverse direction of the reinforcement support frame, and at least one of which can be displaced with respect to the other along the longitudinal direction of the reinforcement support frame and in between which an appropriate clamping gap whose width is adjusted and is open both at the top and bottom is defined.

11. The process of claim 10, wherein the reinforcement support frame is held in a stationary position and the supporting bars are clamped by the clamping equipment.

12. The process of claim 10, wherein the clamping bars are moved towards each other and the supporting bars are clamped between these bars in a stably positioned manner.

13. The process of claim 10, wherein for gripping the reinforcements that are aligned in the aligning or positioning device, the reinforcement support frame is lowered to the top of the aligning or positioning device, such that the longitudinal and transverse beams of the reinforcement support frame are aligned in a parallel and perpendicular manner to the support walls of the aligning device, respectively, and the upper ends of the supporting bars are introduced into the clamping gap while lowering the reinforcement support frame.

* * * * *